US011406168B2

(12) United States Patent
Briana et al.

(10) Patent No.: US 11,406,168 B2
(45) Date of Patent: Aug. 9, 2022

(54) SOLID PRODUCT DISPENSER

(71) Applicant: BRIANA, LLC, Sierra Madre, CA (US)

(72) Inventors: Thomas William Briana, Altadena, CA (US); David Louis Worrell, Pasadena, CA (US); Niclas Henning Zieger, Passadena, CA (US)

(73) Assignee: BRIANA, LLC, Sierra Madre, CA (US)

( * ) Notice: Subject to any disclaimer, the term of this patent is extended or adjusted under 35 U.S.C. 154(b) by 91 days.

(21) Appl. No.: 17/089,292

(22) Filed: Nov. 4, 2020

(65) Prior Publication Data

US 2021/0145147 A1 May 20, 2021

Related U.S. Application Data

(60) Provisional application No. 62/930,376, filed on Nov. 4, 2019.

(51) Int. Cl.
*A45D 40/02* (2006.01)
*A45D 40/00* (2006.01)

(52) U.S. Cl.
CPC ..... *A45D 40/02* (2013.01); *A45D 2040/005* (2013.01)

(58) Field of Classification Search
CPC ..... A45D 40/02; A45D 2040/005; A45D 2040/0025; A45D 2040/0031; A45D 2040/0043
See application file for complete search history.

(56) References Cited

U.S. PATENT DOCUMENTS

| | | | | |
|---|---|---|---|---|
| 4,595,124 | A | 6/1986 | Duval et al. | |
| 4,865,231 | A | 9/1989 | Wiercinski | |
| 4,884,912 | A | 12/1989 | Gueret | |
| 4,890,944 | A | 1/1990 | Cousins et al. | |
| 5,000,356 | A | 3/1991 | Johnson et al. | |
| 5,102,249 | A | 4/1992 | Holloway et al. | |
| 5,399,040 | A | 3/1995 | Holloway | |
| 5,833,382 | A * | 11/1998 | Jenks | A45D 40/02 401/262 |
| 5,984,551 | A | 11/1999 | Kinney, Jr. | |
| 5,984,553 | A | 11/1999 | Piscopo et al. | |
| 6,210,061 | B1 | 4/2001 | Johnson | |
| 6,592,278 | B1 * | 7/2003 | Holthaus | A45D 40/04 401/175 |

(Continued)

FOREIGN PATENT DOCUMENTS

WO WO2007043092 * 4/2007 ..... A45D 40/02

*Primary Examiner* — J C Jacyna
(74) *Attorney, Agent, or Firm* — Brooks Kushman P.C.

(57) ABSTRACT

A dispenser is disclosed for a solid or semi-solid product that includes an outer shell and a slider disposed inside the outer shell. The dispenser also includes an inner shell defining an opening and a carrier adapted to retain the product in the inner shell. The carrier includes carrier teeth that are engaged by an actuator connected between the slider and the carrier for advancing the carrier and the product. The actuator includes at least two drive arms that extend through the inner shell and into the carrier. The drive arms include drive teeth that are adapted to engage the carrier teeth. The carrier and product are replaceable, and the outer shell, the inner shell, and the actuator may be reused.

20 Claims, 17 Drawing Sheets

(56) References Cited

U.S. PATENT DOCUMENTS

| | | | | |
|---|---|---|---|---|
| 7,845,874 | B2 | 12/2010 | Crosnier et al. | |
| 9,210,985 | B2 | 12/2015 | Arwatz et al. | |
| 10,278,473 | B2 | 5/2019 | Groffsky et al. | |
| 2009/0028625 | A1* | 1/2009 | Bonneyrat ..... | A45D 40/205<br>401/55 |
| 2009/0214383 | A1* | 8/2009 | Petruno ..... | G01N 33/558<br>422/400 |

* cited by examiner

SOLID PRODUCT DISPENSER

REFERENCE TO RELATED APPLICATIONS

This application claims the benefit of U.S. provisional application Ser. No. 62/930,376 filed Nov. 4, 2019, the disclosure of which is hereby incorporated in its entirety by reference herein.

TECHNICAL FIELD

This disclosure relates to a dispenser for solid or semi-solid products.

BACKGROUND

Items such as lipstick and deodorant are often dispensed in a tube or similar dispenser with a product advancing mechanism. One type of advancing mechanism is generally a screw thread including a male screw thread portion that is axially affixed but is rotatable relative to the outer package. A carrier portion is axially movable relative to the outer package but rotatably fixed to the outer package and has a complementary female screw thread. As the male screw thread is turned, the female screw thread travels in the axial direction to advance or retract the product to be dispensed from the outer package. One problem with this design is that the entire package, often much or most of which is a form of plastic or other non-biodegradable material, is designed to be disposed of once the product is consumed. Another disadvantage is that the packaging is made of inexpensive materials reducing the overall aesthetics of the package.

The above type of dispenser does not allow for a quick advancement and retraction of the product. To advance or retract the product relative to the outer package, the threaded portion must be turned multiple times.

There is a need for a dispenser that is reusable and reduces the amount of disposable packaging material while providing a more aesthetically pleasing outer package.

There is also a need to provide an outer package that is adapted to receive a refill of the product to be dispensed that can be exchanged for another product quickly and easily.

SUMMARY

This disclosure is directed to a consumable product dispenser and method of storing and dispensing solid or semi-solid consumable products such as lipstick, deodorant, candy, sunscreen or a solid shaving product. (available from Briana Ltd.) The consumable product is packaged on a disposable carrier that can be assembled to non-disposable portions to reduce overall packaging material requirements. In addition, the non-disposable portions can be made of more durable or aesthetically pleasing materials.

As an alternative, the outer package and consumable product could be integrated into a wholly disposable assembly having the disclosed advancement mechanism.

The consumable product dispenser will be described in greater detail below with reference to the attached drawings.

BRIEF DESCRIPTION OF THE DRAWINGS

FIGS. 32A-34A are detailed views taken within the circled areas of FIGS. 32-34.

DETAILED DESCRIPTION

Detailed embodiments of the present invention are disclosed. The disclosed embodiments are merely examples of the invention that may be embodied in various and alternative forms. The figures are not necessarily to scale, and some features may be exaggerated or minimized to show details of particular components. The specific structural and functional details disclosed are not to be interpreted as limiting, but merely as a representative basis for teaching one skilled in the art to practice the present invention. The terms upward and downward as used herein refer to the orientation of the drawings in the figures and should not be construed to limit the orientation of the dispenser when in use which could be any orientation.

Referring generally to the Figures, a packaging system 10, or dispenser, is disclosed in which a consumable product 12 is contained and protected in a product cartridge 14 that is adapted to be received in a dispenser housing 16 by assembling the product cartridge 14 to the dispenser housing 16.

Figure 1:
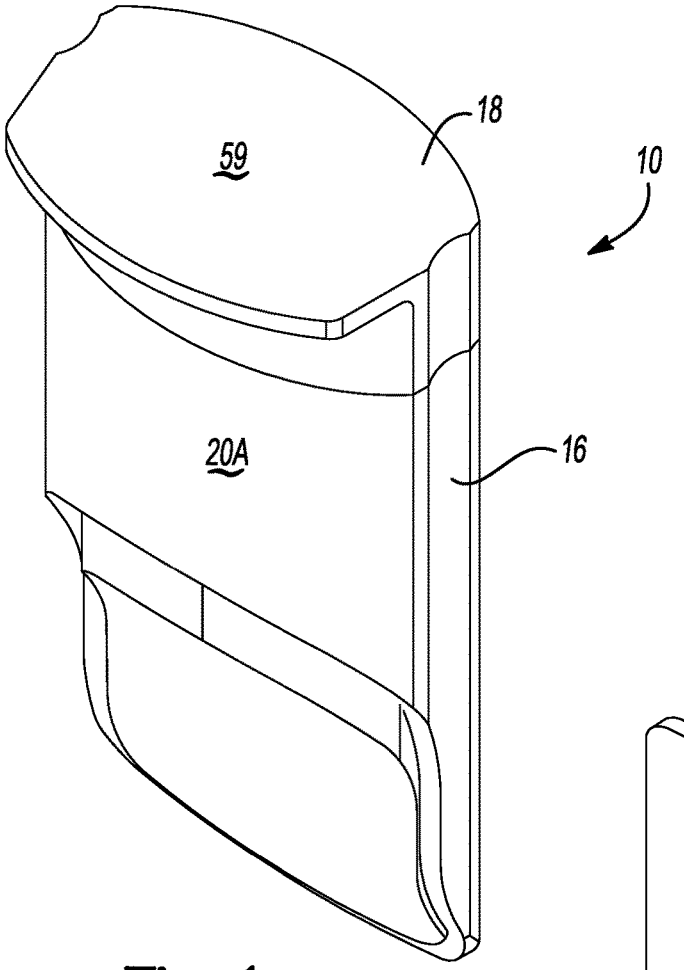
FIG. 1 is a perspective view of the assembled package in the loaded and capped configuration.
Figure 2:
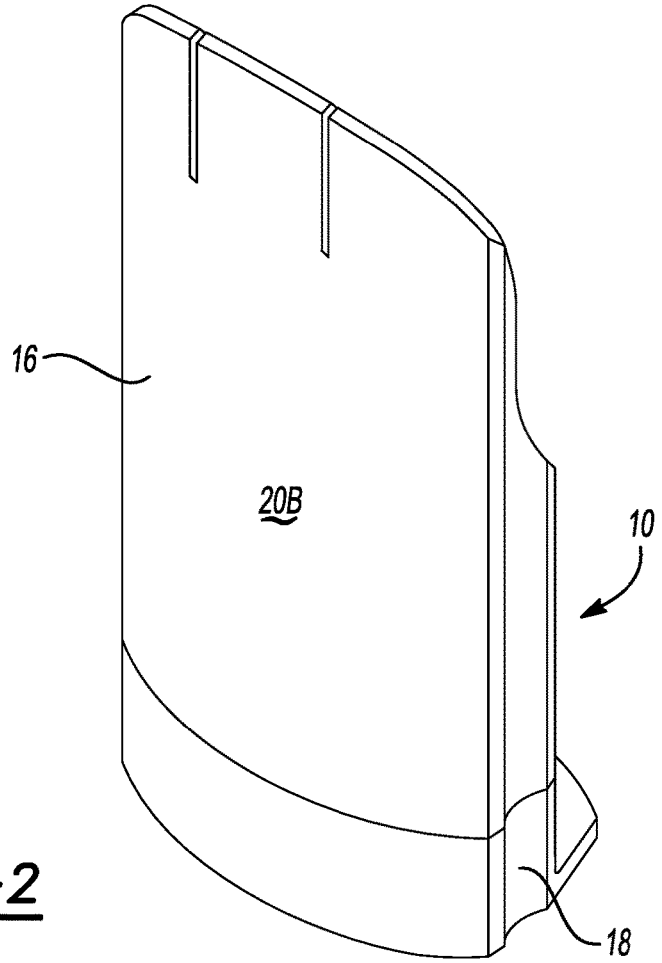
FIG. 2 is an opposite perspective view of FIG. 1 rotated 180° along an axis extending from top-left to bottom-right.
Figure 3A:
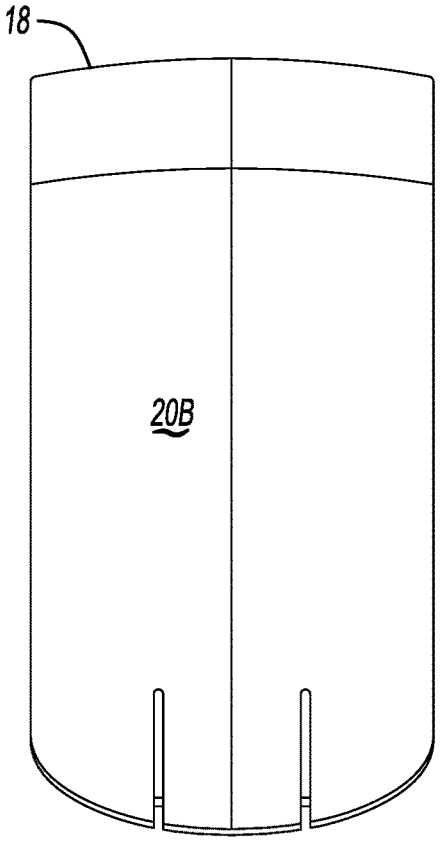
FIGS. 3A-3F are back, left side, front, right side elevation views, top and bottom plan views of the of the component parts of the package.
Figure 3B:
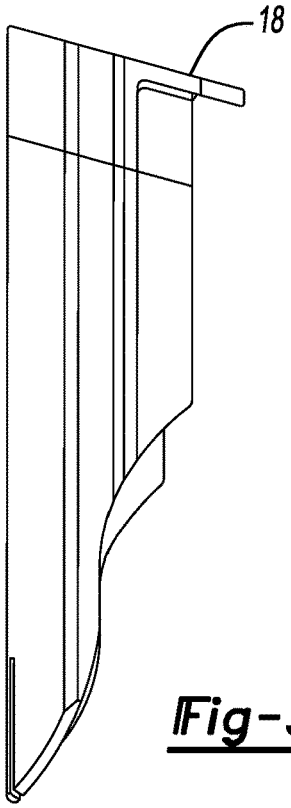
Figure 3C:
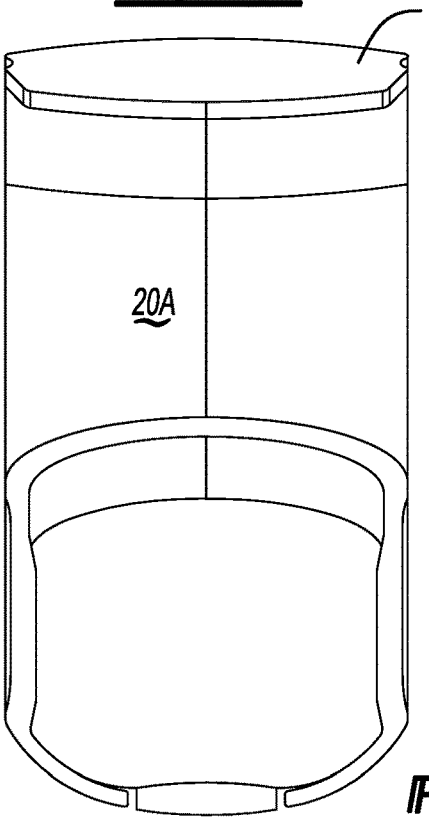
Figure 3D:
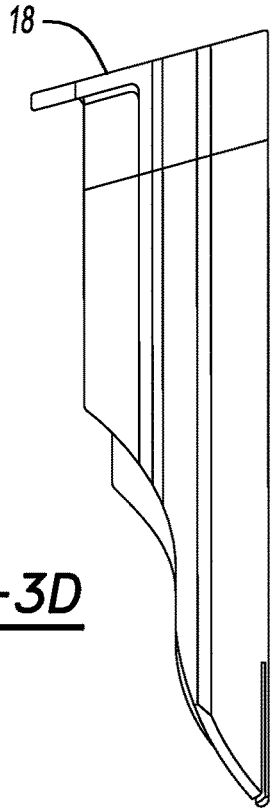
Figure 3E:
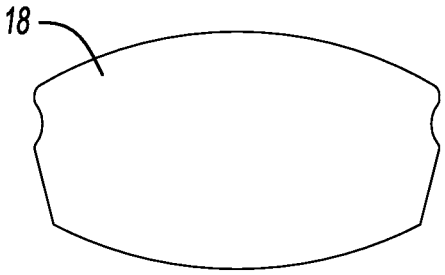
Figure 3F:
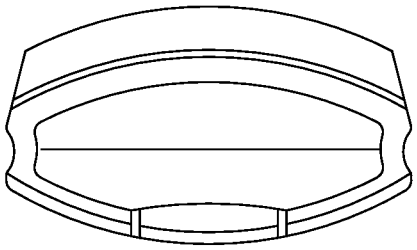

FIGS. 1-3 show an assembled package system 10 with a protective cap 18. The consumable product 12 is not visible in FIGS. 1-3 as it is protected on all sides by the dispenser housing 16 made of plastic or metal. The dispenser housing 16 protects the consumable product 12, and reduces the possibility of transferring the consumable product 12 to the hands or otherwise unintended transfer of the consumable product 12.

Figure 4:
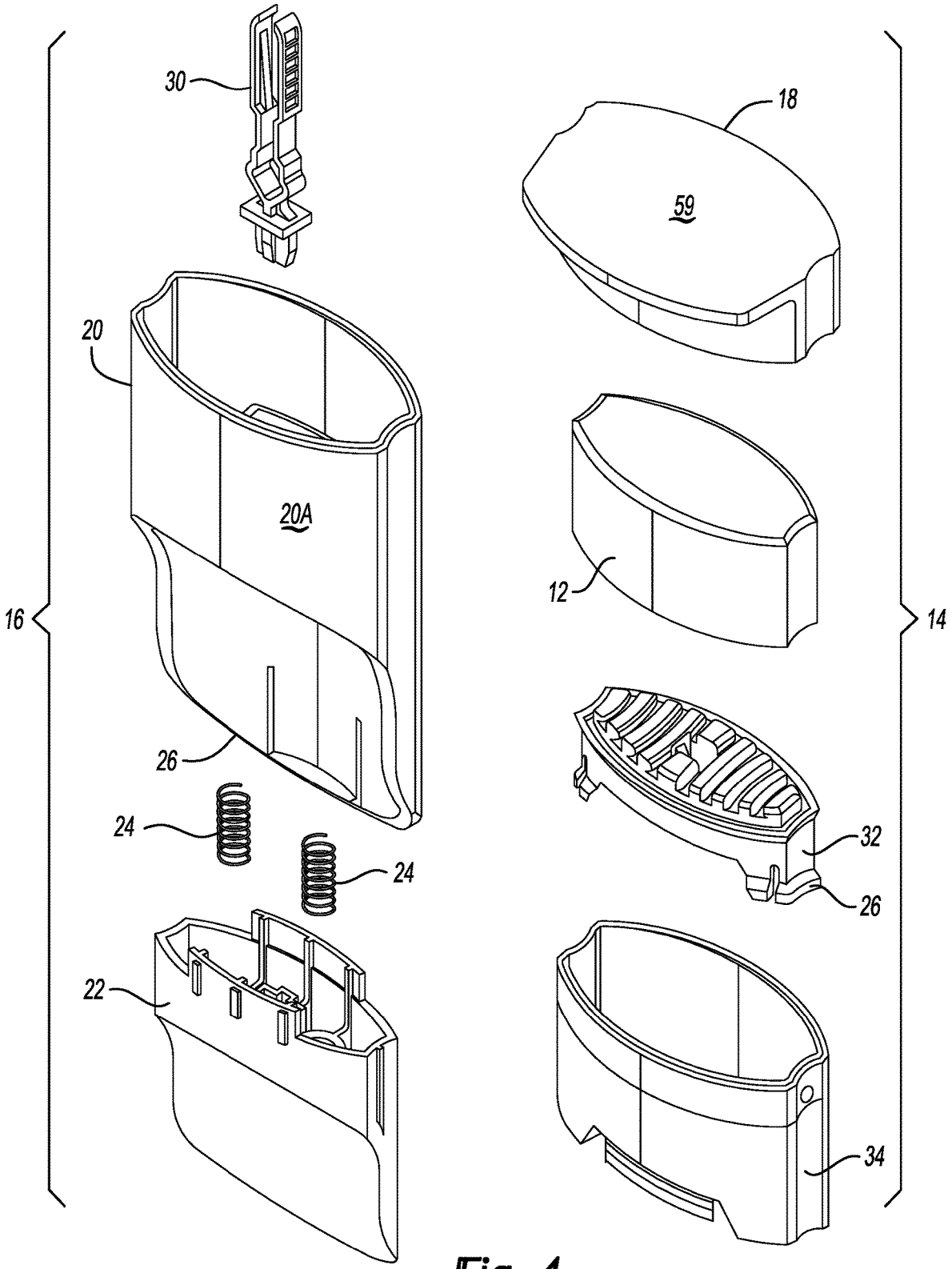
FIG. 4 is an exploded perspective view of the package of FIG. 1.
Figure 5:
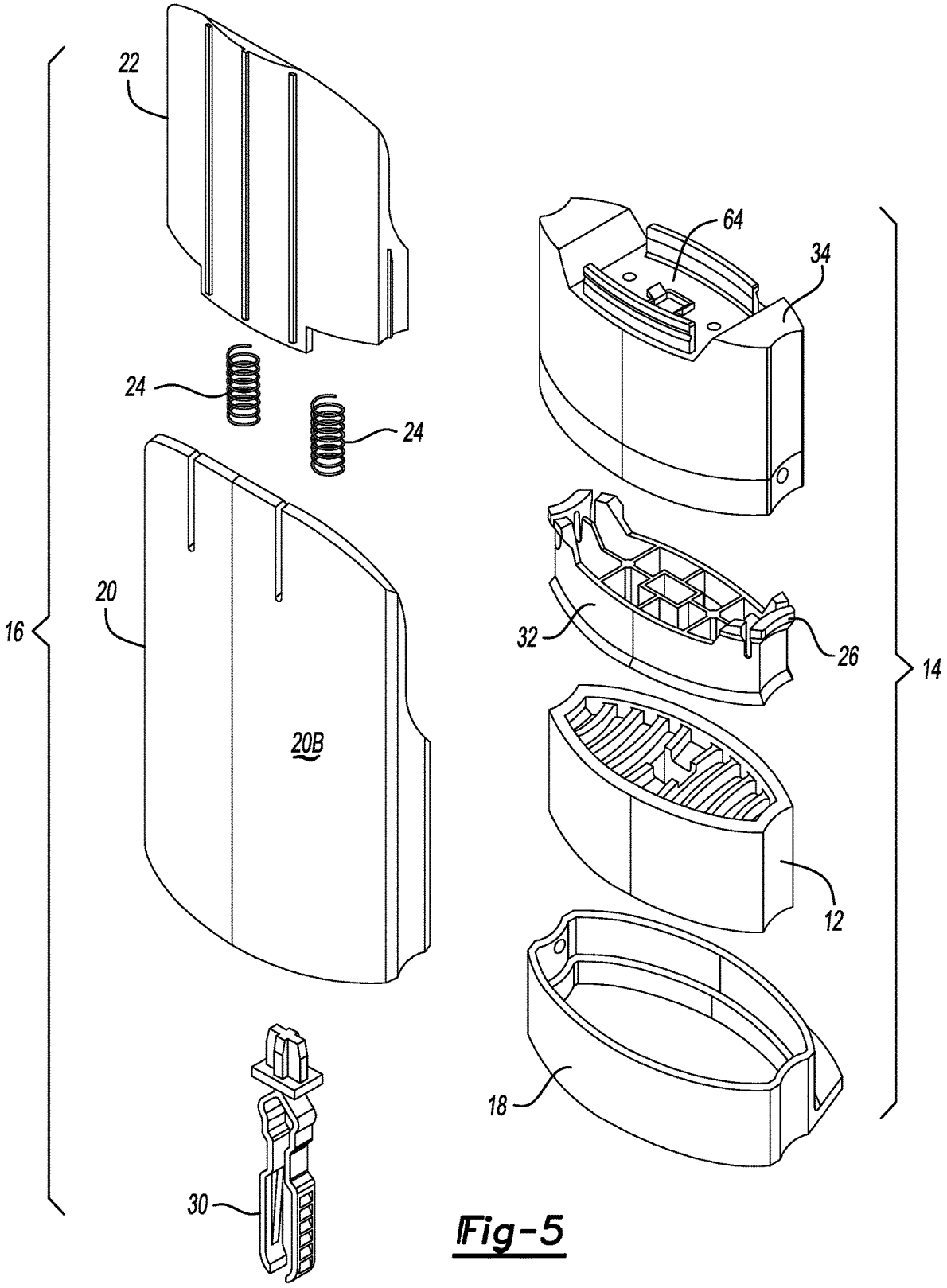
FIG. 5 is an inverted exploded perspective view of the package of FIG. 1.

FIGS. 4 and 5 show the complete packaging system 10 in an exploded prospective view. The dispenser housing 16 includes an outer shell 20 adapted to receive a slider 22 that is inserted into the outer shell 20. Helical compression springs 24 are disposed between the inner shell 34 and the slider 22 to bias the slider 22 away from the inner shell 34. The springs 24 can be of any number and made of any suitable material including steel, foam or air in a plastic bubble. A retaining latch 26 at the base of the carrier 32 retains the carrier 32 within the inner shell 34 during normal use. An extension and retraction actuator 30 (hereinafter the "actuator") is fixedly attached to the slider 22.

The product cartridge 14 includes the carrier 32 and is inserted into the inner shell 34. The inner shell 34 with carrier 32 is placed into the cap 18. The consumable product 12 (hereinafter the "product") is filled in a liquid or semi-liquid state through the central rectangular opening of the inner shell 34 and the carrier 32. The inner shell 34 is filled until the top surface of the product 12 comes into contact with the bottom surface of the carrier 32. The product 12 is allowed to cool to change to a solid or semi-solid state. An adhesive bond is created when the product 12 contacts the carrier 32. This is an efficient method of packaging the product 12 within the final package, eliminating the need for separate casting tooling and processes.

Figure 6:
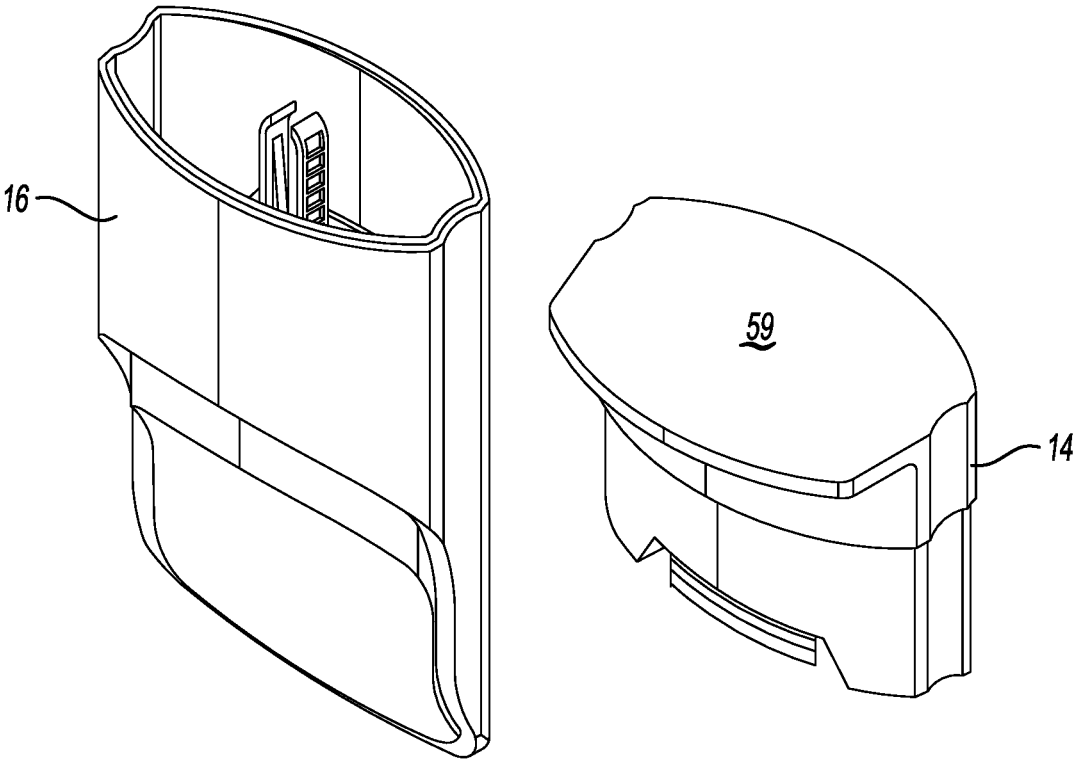
FIG. 6 is a perspective view of the outer package without the product shown next to an assembled reloadable product cartridge 14 and cap.
Figure 7:
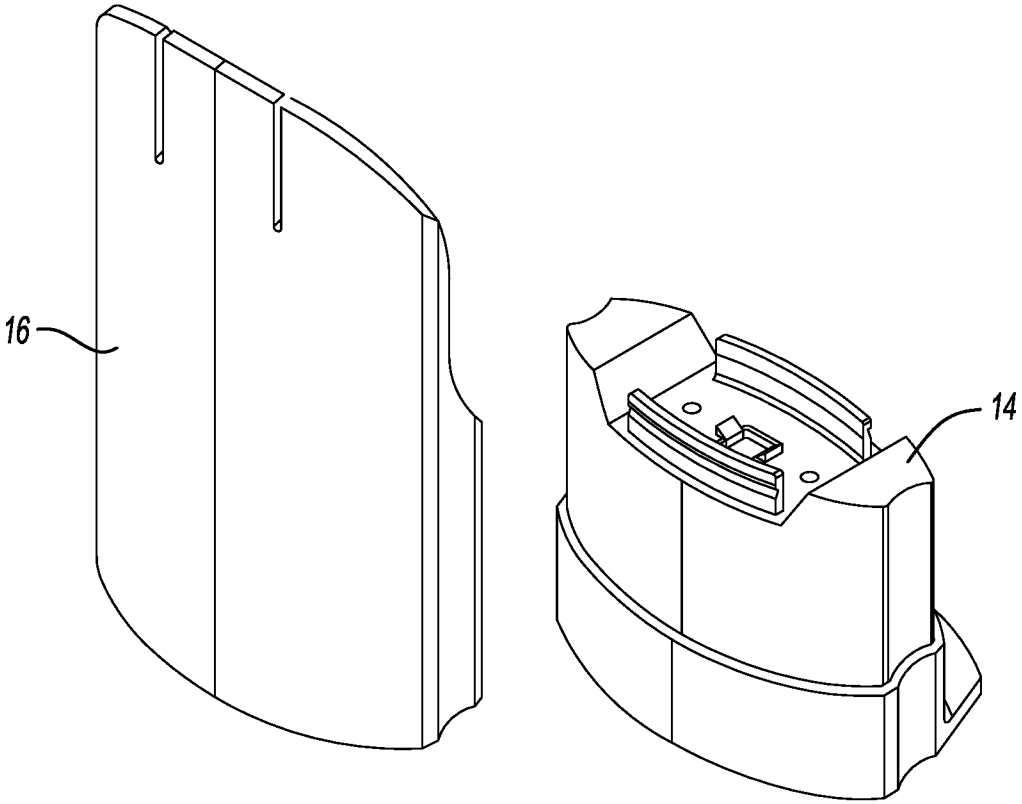
FIG. 7 is a reverse perspective view of the package, cartridge, and cap of FIG. 6.

FIGS. 6 and 7 show the completed dispenser housing 16 and product cartridge 14 assemblies. These assemblies can now be assembled to each other while remaining separable as described below.

FIGS. 8 through 13 show the product cartridge 14 being assembled to the dispenser housing 16 for initial use.

Figure 8:
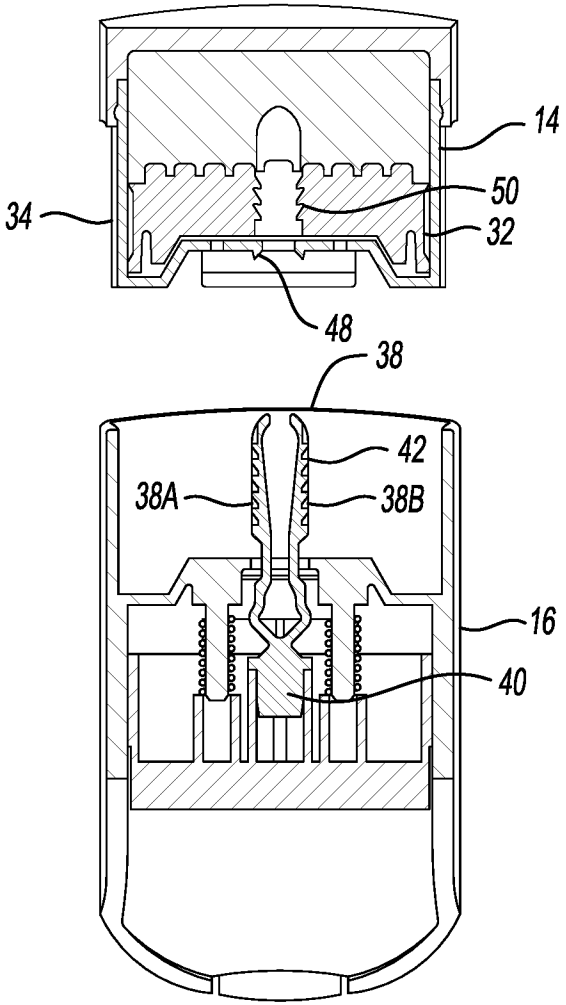
FIG. 8 is a central vertical plane/widthwise cross-section view of the outer package without the dispensable product, a reloadable product cartridge, and cap aligned for loading the product cartridge into the outer package.
Figure 11:
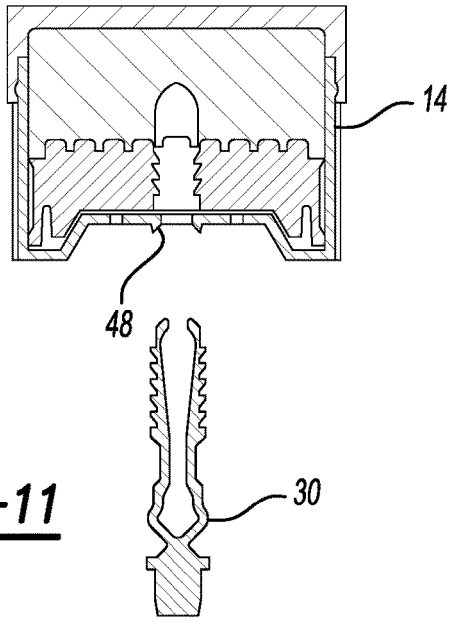
FIG. 11 is a central vertical plane/widthwise cross-section view of the outer package, product cartridge, and cap with the advancement and retraction actuator separated from the consumable product cartridge.
Figure 12:
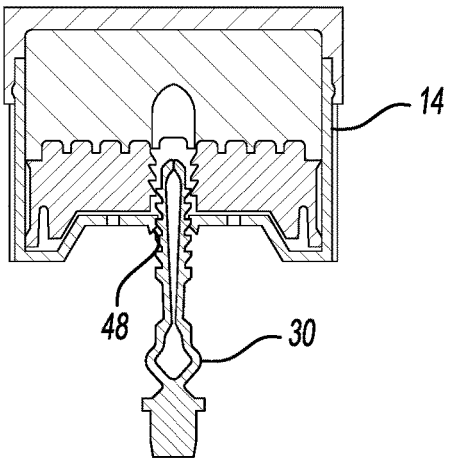
FIG. 12 is a central vertical plane/widthwise cross-section view of the outer package, product cartridge, and cap with the advancement and retraction actuator partially received in the consumable product cartridge.

FIGS. 8 and 11 show the product cartridge 14 in longitudinal axial alignment to the dispenser housing 16. The actuator 30 is in a relaxed state, or expanded position, shown in FIG. 36A through 38A. In the relaxed state, the actuator arms 38A and 38B are angled away from the vertical axis starting at the base 40 where the arms meet by ½°, 1°, 2° or an amount that compensates for the material elastic properties. The material may be plastic, metal, a composite of plastic and metal, or any other material or combination of materials exhibiting elastic deflection. The angled displacement of the arms 38A and 38B allows force to be applied between the arms 38A and 38B and the receiving elements of the carrier 32 as discussed below.

Figure 9:
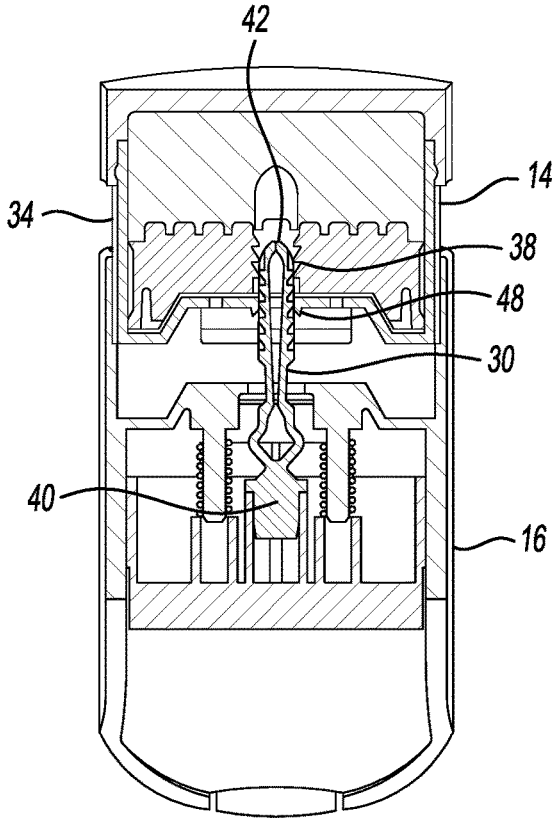
FIG. 9 is a central vertical plane/widthwise cross-section view of the outer package, product cartridge, and cap in an intermediate condition.
Figure 36B:
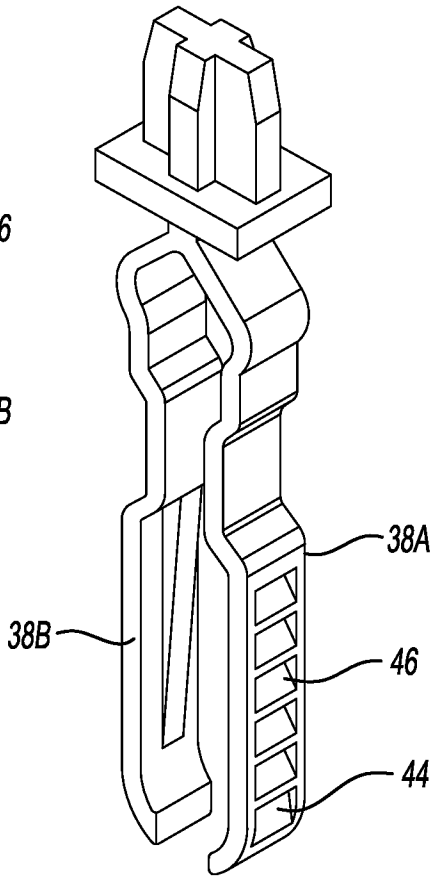
FIG. 36B is an opposite perspective view of FIG. 36A rotated 180° along an axis extending from top-left to bottom-right.
Figure 36A:
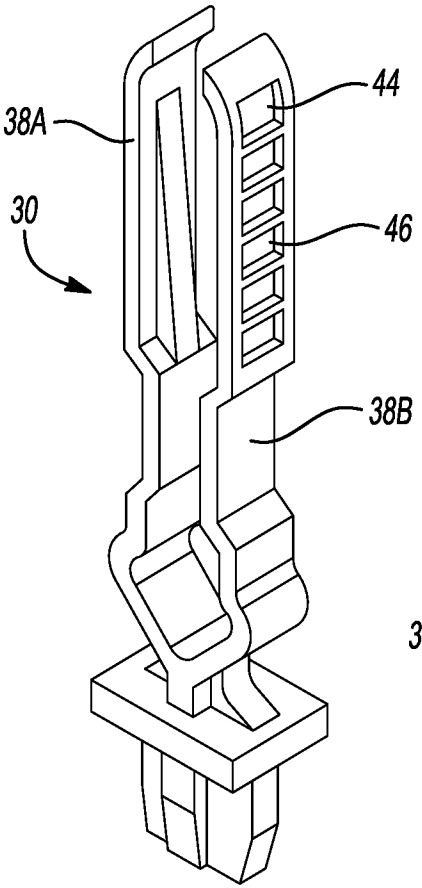
FIG. 36A is a perspective view of the advancement and retraction actuator.

FIG. 9 shows the product cartridge 14 assembled to the dispenser housing 16 in an intermediate position. The actuator arms 38A and 38B are shown to be displaced inwardly in FIG. 38B. The lateral distance, or width, of the shell opening 48 at the base of the inner shell 34 is less than the spacing of the widest portion of the actuator arms 38A and 38B. The inwardly facing tips 42 of the actuator 30 at the top end initiate the deflection of the arms 38. The actuator arms 38A and 38B have a rail portion 44 as shown in FIGS. 36A and 36B that act as a rail guiding the teeth 46 through the shell opening 48. Displacement of the teeth 46 of the actuator 30 clears the teeth 50 of the carrier 32.

The product cartridge 14 slides into the dispenser housing 16 without changing the position of the carrier 32 and product 12 in relation to the lower shell 34 and cap 18.

Figure 10:
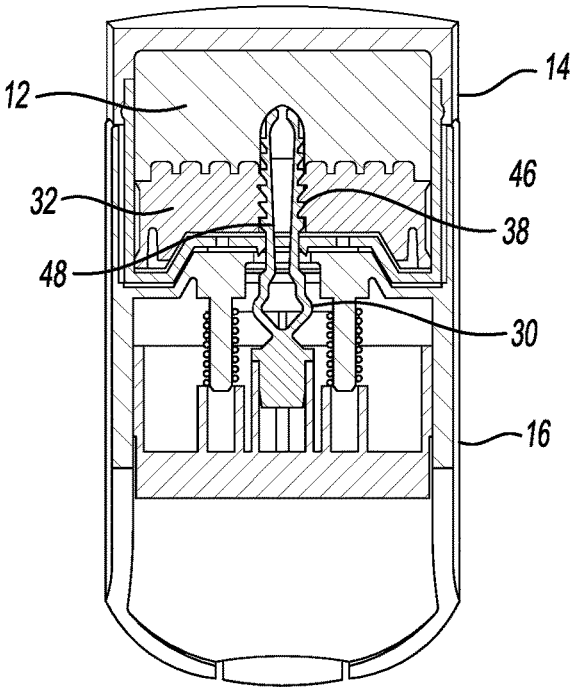
FIG. 10 is a central vertical plane/widthwise cross-section view of the outer package, product cartridge, and cap in a loaded condition.
Figure 13:
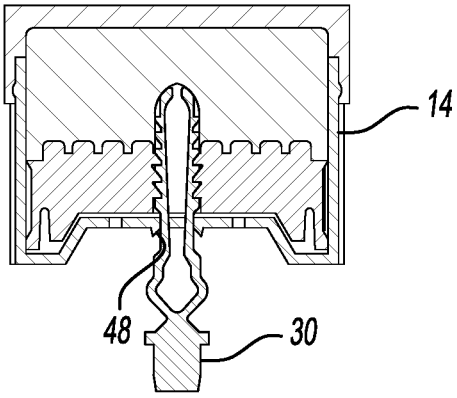
FIG. 13 is a central vertical plane/widthwise cross-section view of the outer package, product cartridge, and cap with the advancement and retraction actuator fully received in the consumable product cartridge.
Figure 38C:
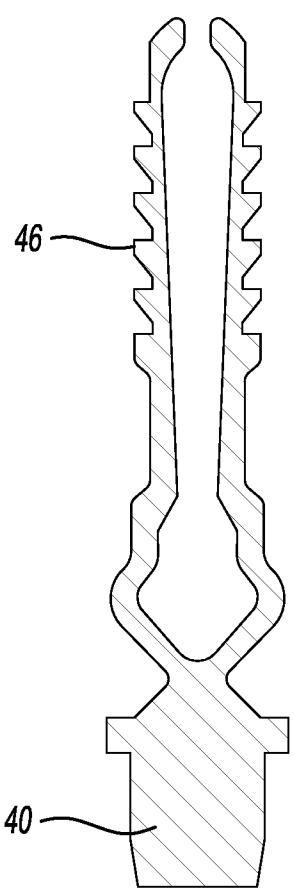
FIG. 38A-38C are a series of views of the advancement and retraction actuator different positions.

FIGS. 10 and 13 show the product cartridge 14 fully assembled to the dispenser housing 16. The drive arms 38A and 38B are in an engaging position as also shown in FIG. 38C. The lateral width of the shell opening 48 at the base of the inner shell 48 is equal to or greater than the width of the proximate portion of the drive arms 38A and 38B. The teeth 46 of the actuator 30 engage the teeth of the carrier 32 to advance the product 12.

Figure 32:
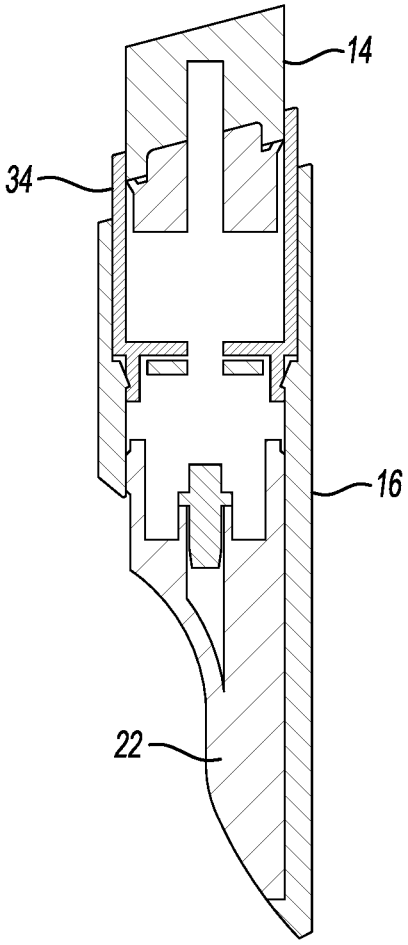
FIGS. 32-35 are central vertical plane/front to back views showing a progression of steps for removing the consumable product cartridge.
Figure 32A:
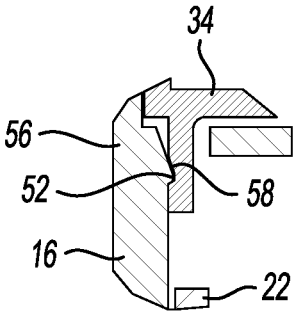

Referring to FIGS. 32 and 32A, the shell latch 52 at the base wall 62 of the inner shell 34 engages a complementary dispenser latch 56 on the dispenser housing 16. The shell latch 52 includes an angled ramp surface 58 of approximately 20° from vertical allows the shell latch 52 to slide past the dispenser latch 56. The angle may be in a range between 0° to 90° to accommodate the overall requirements of the system. Once latched, the product cartridge 14 is affixed to the inner shell 34 of the dispenser housing 16.

FIGS. 14 through 23 show the product 12 being advanced within the dispenser housing 16.

Figure 14:
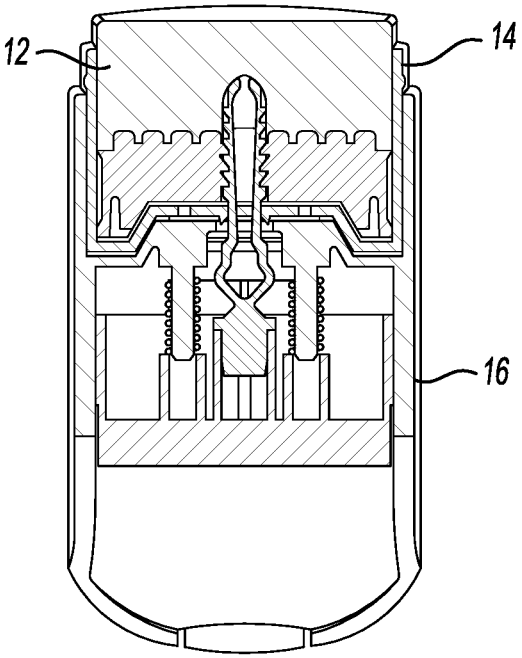
FIG. 14 is a central vertical plane/widthwise cross-section view of the outer package with an assembled reloadable product cartridge in a loaded condition with the protective cap removed.
Figure 19:
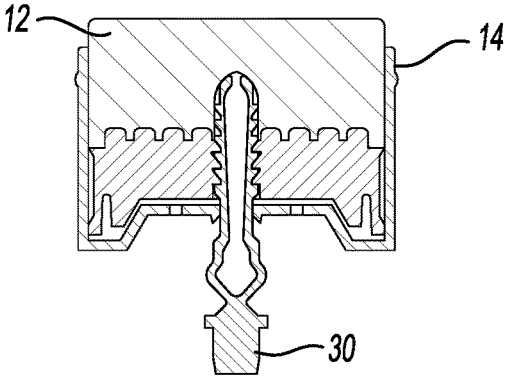
FIGS. 19-21 are central vertical plane/widthwise cross-section views of the advancement and retraction actuator fully received in the reloadable consumable product cartridge with the protective cap removed in several stages of advancement.

FIGS. 14 and 19 show the initial state of the product 12 for use, like FIG. 10, but with the protective cap 18 removed. With the cap 18 removed, a portion of the product 12 is exposed and may be placed in contact with a surface for application of the product 12. The exposed portion may also be cut off as a slice. During application or after slicing, the product 12 is consumed.

Figure 15:
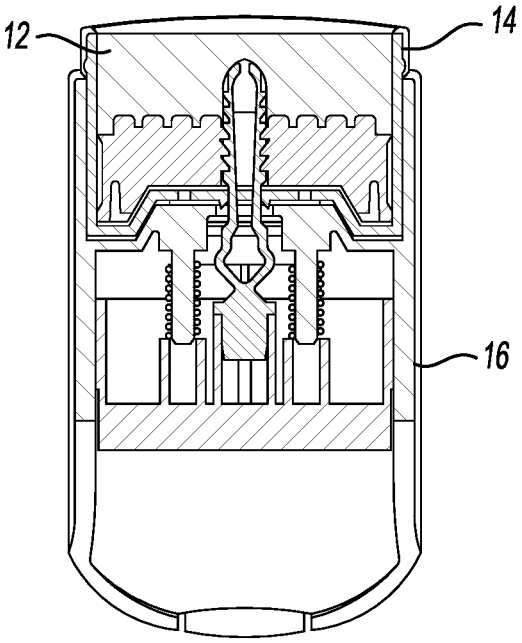
FIG. 15 is a central vertical plane/widthwise cross-section view of the outer package with an assembled reloadable product cartridge in a loaded condition with a portion of the product used.
Figure 20:
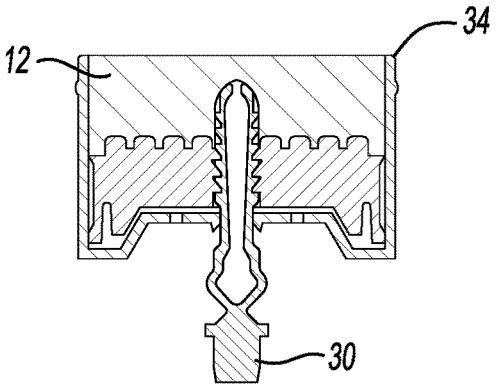

FIGS. 15 and 20 show the top exposed portion of the product 12 missing due to consumption. The top surface of the product 12 is now aligned with the top edge surface of the inner shell 34.

Figure 41:
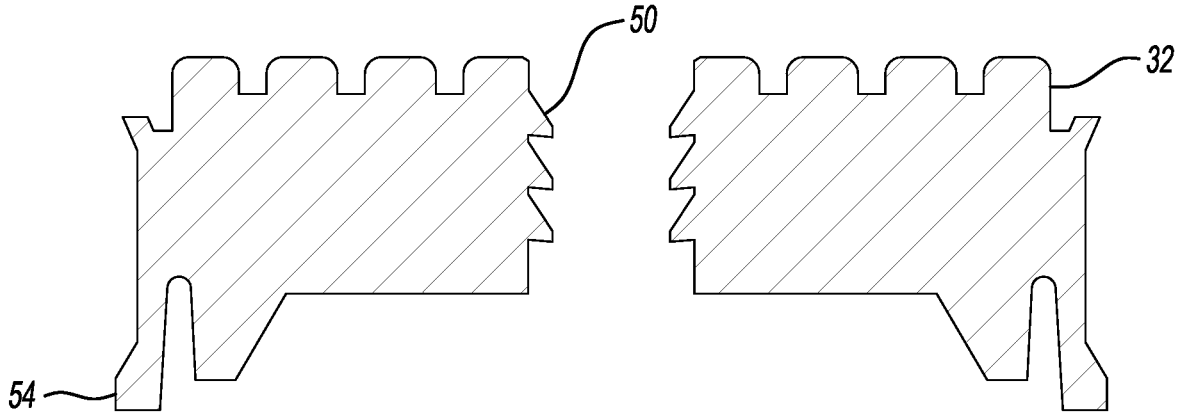
FIG. 41 is a central vertical plane/widthwise view of the carrier.
Figure 42:
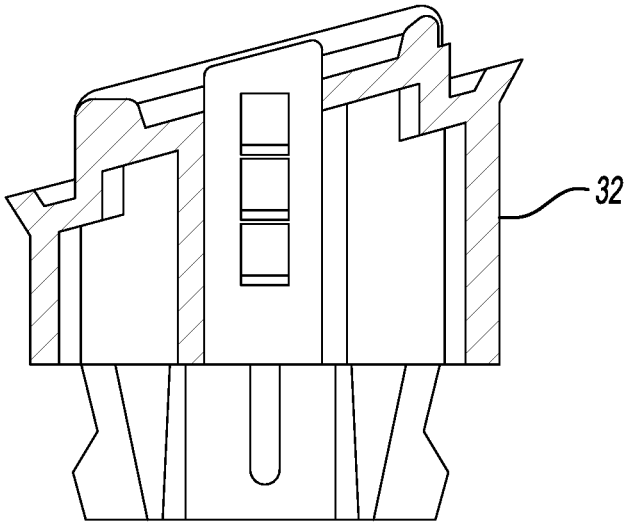
FIG. 42 is a central vertical plane/front to back view of the carrier.

Referring to FIGS. 38C and 41, the drive teeth 46 engage the carrier teeth 50. The drive teeth 46 of FIG. 38C are biased by the springs 24 in an upward direction while the mating teeth 50 of the carrier 32 shown in FIG. 41 are biased in the downward direction. FIGS. 10 through 31 show the teeth 46, 50 being intermittently engaged with one another. Biasing the mating teeth 46, 50 allows the actuator 30 to advance the carrier 32. As the actuator 30 moves downwardly, the angled portions of the teeth-pairs allow the actuator 30 to slip past the carrier 32. The carrier 32 is held in place within the inner shell 34 by a frictional force greater than the frictional force of the drive teeth 46 slipping past the carrier teeth 50.

The carrier 32 includes a skirt 54 disposed around the outer edge of the carrier 32. The skirt 54 is slightly larger than the surrounding interior wall of the inner shell 34. This creates an interference fit between the carrier 32 and the shell 34 and provides frictional resistance. The skirt 54 is made of an elastic material such as plastic, metal, foam or a composite of materials that allows interference between the skirt 54 and shell 34 to apply a frictional force within a range that balances the forces applied by the actuator 30 including an input force and the biasing force applied by the springs 24. The frictional force holds the carrier 32 in a fixed spatial location relative to the inner shell 34 as the drive teeth 46 slip downwardly past the carrier teeth 50.

Figure 16:
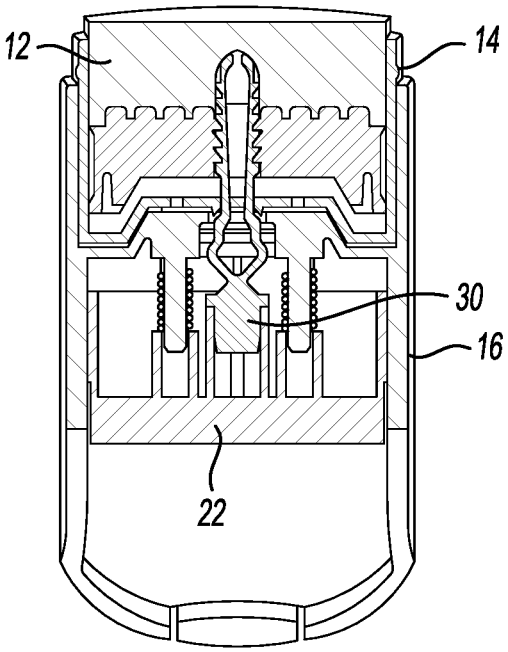
FIG. 16 is a central vertical plane/widthwise cross-section view of the outer package with an assembled reloadable product cartridge in a loaded condition in an initial product advancement configuration.
Figure 21:
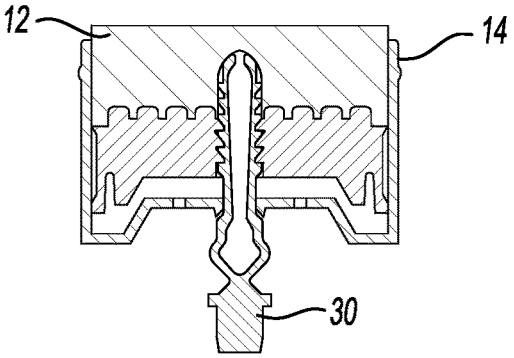

FIGS. 16 and 21 show an initial advancement of the product 12. An upward input force applied to the slider 22 moves the actuator 30 which is connected to the slider 22 upwardly. The springs 24 assembled within the dispenser housing 16 bias the slider 22 and the actuator 30 downwardly when the input force is released.

Figure 17:
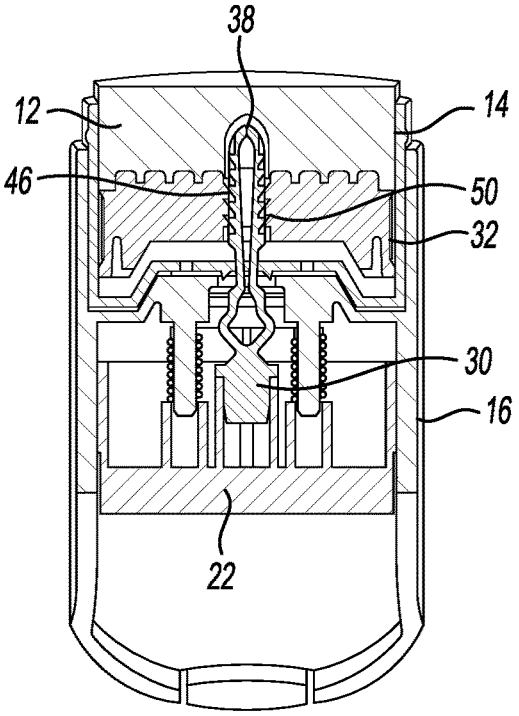
FIG. 17 is a central vertical plane/widthwise cross-section view of the outer package with an assembled reloadable product cartridge in a loaded condition in an intermediate product advancement configuration.
Figure 22:
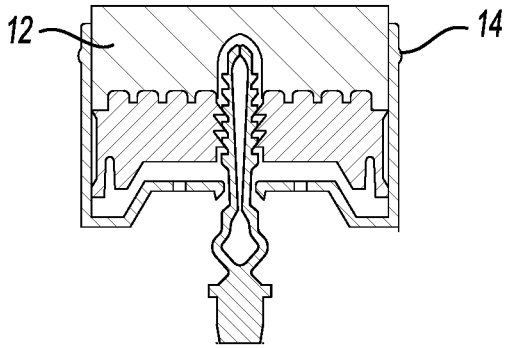
FIGS. 22-25 are central vertical plane/widthwise cross-section views of the advancement and retraction actuator received in the reloadable product cartridge in the process of advancing the product cartridge at an early stage of the product usage.
Figure 38B:
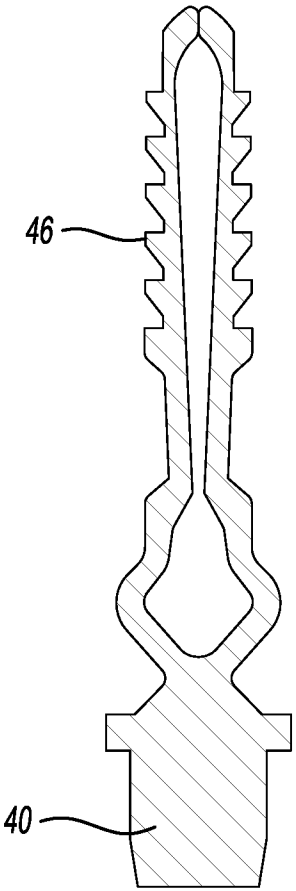
Figure 38A:
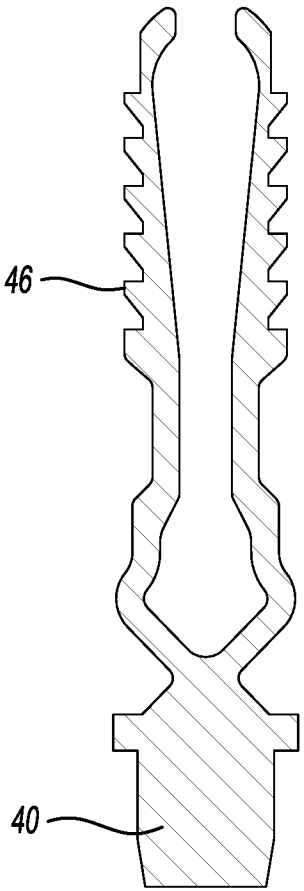
Figure 39:
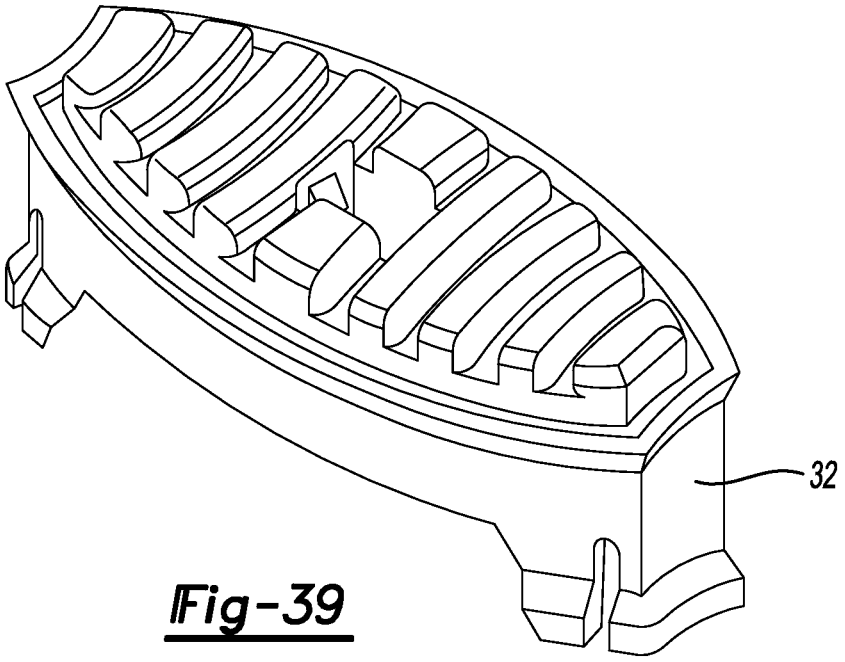
FIG. 39 is a perspective view of the product carrier.
Figure 40:
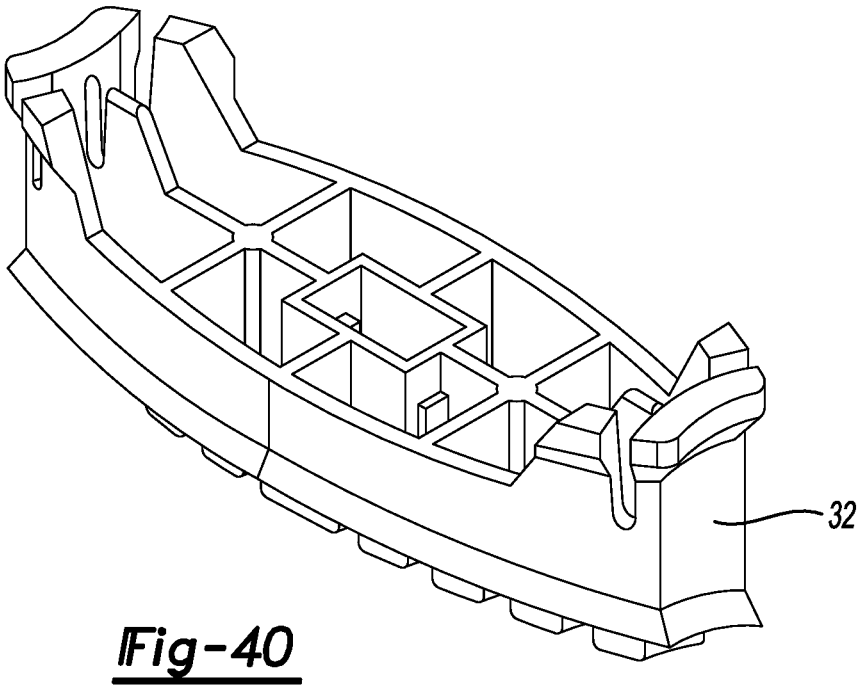
FIG. 40 is an opposite perspective view of FIG. 39 rotated 180° along an axis extending from top-left to bottom-right.

FIGS. 17, 22, and 38B show the drive teeth 46 sliding past the carrier teeth 50. The biasing force applied by the springs 24 returns the slider 22 and the actuator 30 back toward the initial state. The flexibility of the drive arms 38A and 38B allows the drive teeth 46 to slide past the carrier teeth 50. The carrier 32 remains in a fixed location relative to the inner shell by friction.

Figure 18:
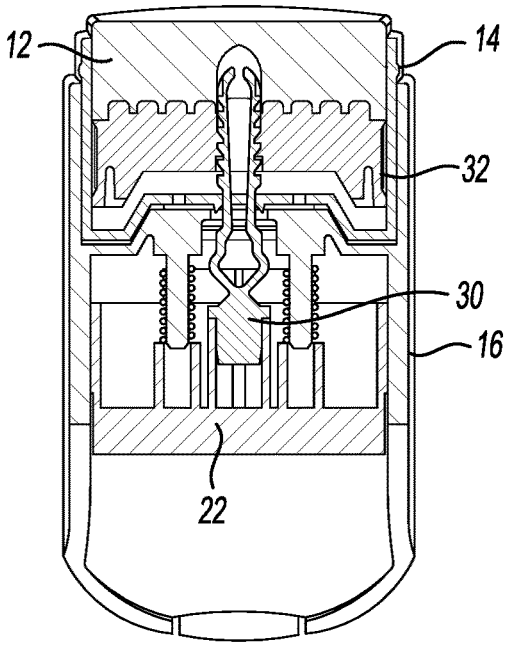
FIG. 18 is a central vertical plane/widthwise cross-section view of the outer package with an assembled reloadable product cartridge in a loaded condition in a final product advancement configuration.
Figure 23:
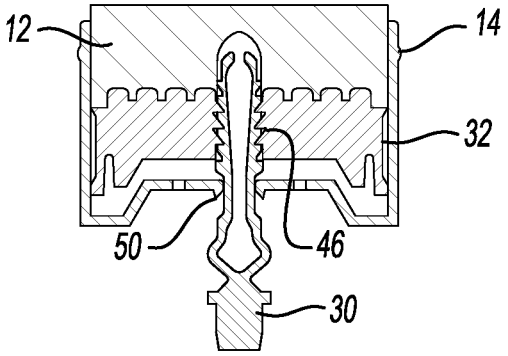
Figure 24:
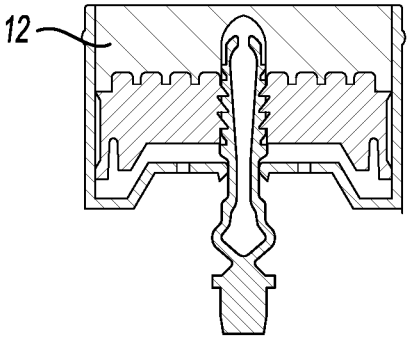
Figure 25:
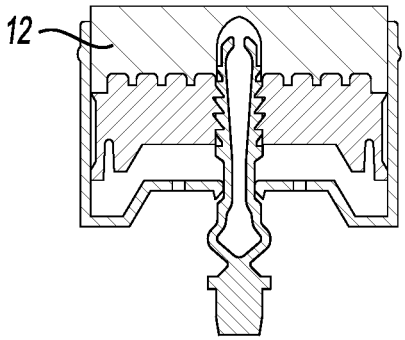
Figure 26:
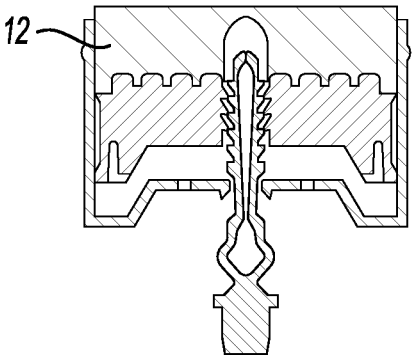
FIGS. 26-31 are central vertical plane/widthwise cross-section views of the advancement and retraction actuator received reloadable product cartridge in the process of advancing the product cartridge at later stages of the product usage.
Figure 27:
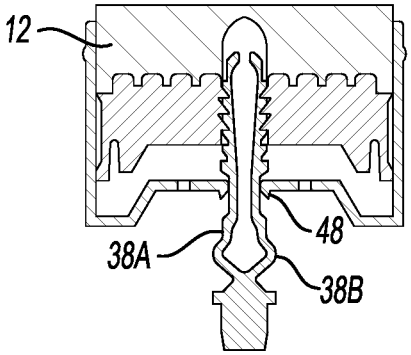

FIGS. 18 and 23 show completed advancement of the product 12. The slider 22 and actuator 30 are in their initial position and the actuator 30 is shown to be returned to the straight configuration of FIG. 38C. The carrier 32 and affixed product 12 are advanced so that a portion of the product 12 is again exposed and may be placed in contact with a surface or sliced off for continued consumption of the product 12.

FIGS. 24 through 27 show another cycle of product advancement like that described above with reference to FIGS. 16 through 23. Another portion of the product 12 has been consumed and the product 12 has been advanced to again expose a portion of the product 12 for continued consumption.

FIGS. 28 through 31 show the product 12 being retracted within the dispenser housing 16. Retraction can be desired if too much of the product 12 has been advanced.

Figure 28:
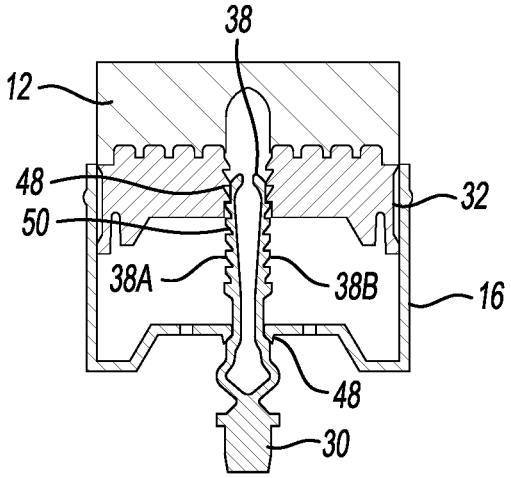
Figure 29:
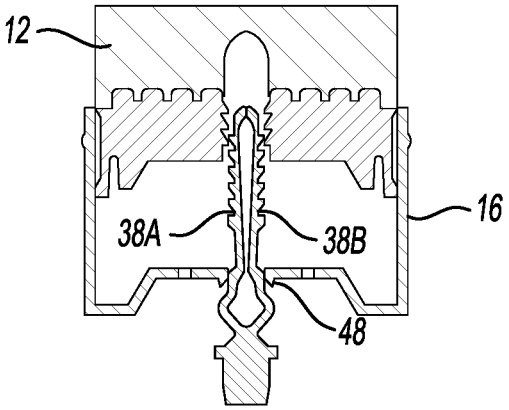
Figure 30:
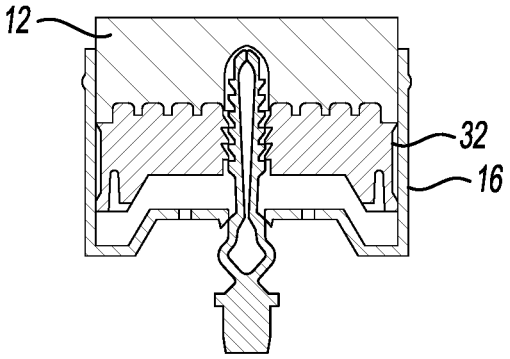
Figure 31:
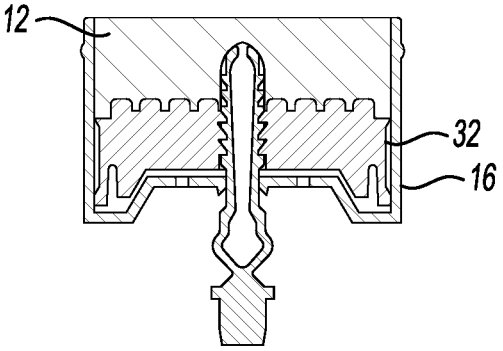

FIG. 28 shows the actuator 30 advanced until the lower outwardly angled portions of the drive arms 38A and 38B are in contact with the shell opening 48. As the actuator 30 is further advanced with additional input force, the angled portions of the drive arms 38A and 38B bias the drive arms 38A and 38B inwardly as shown in FIG. 38B. This allows the drive teeth 46 to disengage the carrier teeth 50. A downward force applied to the product 12 and carrier 32 retracts the product 12 and carrier 32 to a lower position, as shown in FIGS. 30 and 31. It should be noted that this could be done with or without the cap 18 being attached over the top portion of the product 12.

The product cartridge 14 can be removed at any time to replace the fully consumed product cartridge 14 so that the dispenser housing 16 can be provided with accept a new product cartridge 14. A partially consumed product cartridge 14 may be replaced with another product cartridge 14. For example, the product 12 may be made available in different colors or flavors. The product 12 may be made available with products 12 that provide different effects such as calming or energizing effects. The product 12 may also be made available with products 12 that provide different treatments such as treatments for dry hair or oily hair, or different skin conditions such as acne or psoriasis.

Figure 33:
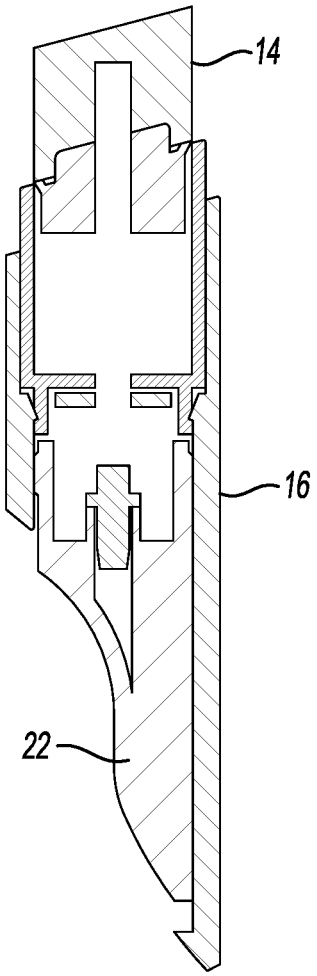
Figure 33A:
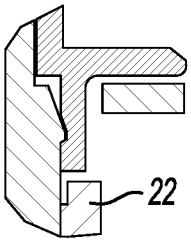
Figure 34:
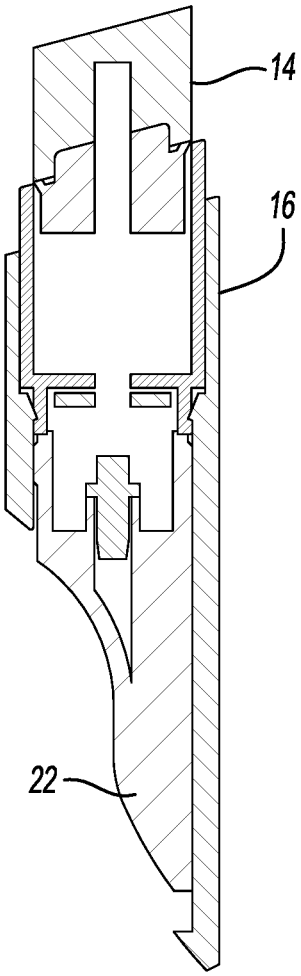
Figure 34A:
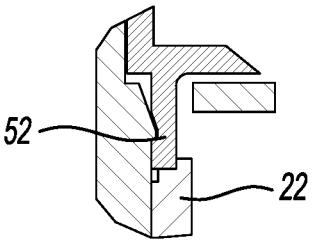
Figure 35:
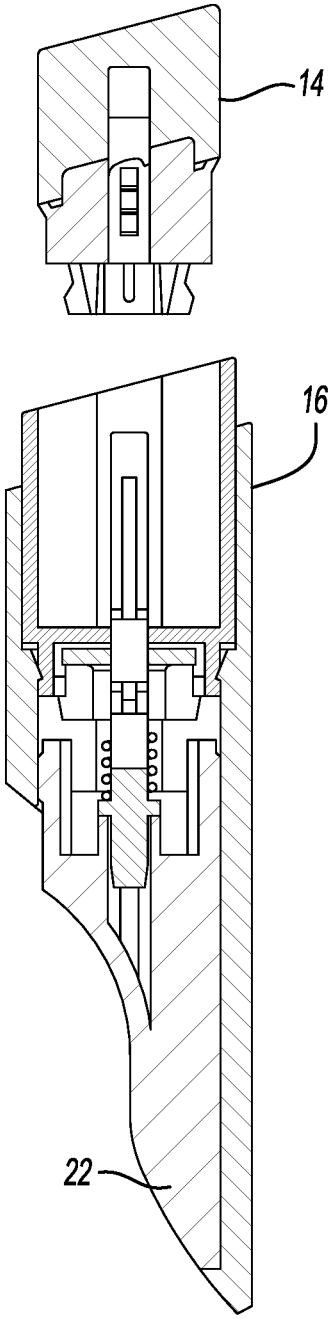
Figure 37B:
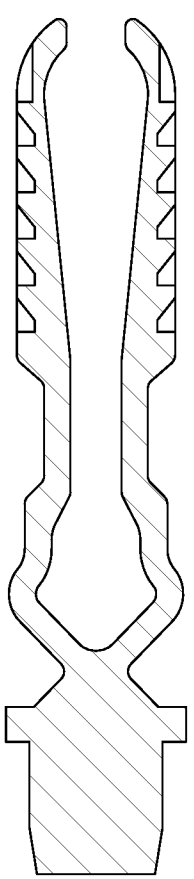
FIG. 37B is a sectional front view of the advancement and retraction actuator.
Figure 37A:
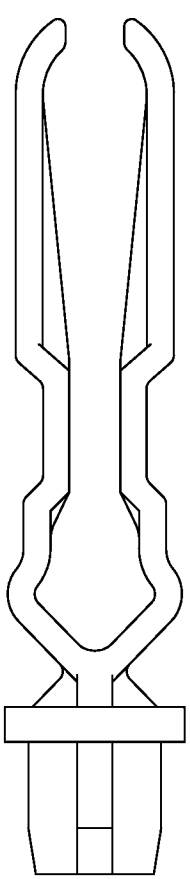
FIG. 37A is front view of the advancement and retraction actuator.

FIGS. 32 through 35 show the product cartridge 14 being removed from the dispenser housing 16. FIG. 32 shows an initial condition. FIG. 32A is a detailed view of a portion of FIG. 32. The inner shell 34 is shown in a latched condition with the dispenser housing 16. The slider 22 is shown below the latch 52. FIGS. 33 and 33A show the slider 22 in an intermediate condition to be closer to the latch than that shown in FIGS. 32 and 32A. FIGS. 34 and 34A show the slider 22 pressing against the latch 52 and applying an upward force to the bottom surface of the latch 52.

The latch 52 is configured with an angled contact area approximately 20° from the horizontal plane. This angle may be in a range of between 0° to 90° depending upon the overall requirements of the system. The upward force applied to the bottom surface of the latch 52 by the slider 22 and the angle of the latch contact area pivots the latch 52 to an unlatched position. The product cartridge 14 is released from the dispenser housing 16 and can now be removed. With the dispenser housing 16 devoid of the product cartridge 14, a new, alternate or the same product cartridge 14 can once again be loaded into the dispenser housing 16 as previously described. It should be noted that this could be done with or without the cap 18 being attached over the top portion of the product 12.

According to one aspect of this disclosure, a dispenser 10 is disclosed for a solid or semi-solid product 12. The dispenser 10 includes an outer shell 20 and a slider 22 disposed inside the outer shell 20. The dispenser 10 also includes an inner shell 34 defining an opening 48 and a carrier 32 adapted to retain the product 12 that is received in the inner shell 34. The carrier 32 includes carrier teeth 50 that are engaged by an actuator 30 connected between the slider 22 and the carrier 32 for advancing the carrier and the product. The actuator includes at least two drive arms 38A and 38B that extend through the inner shell 34 and into the carrier 32. The drive arms 38A and 38B include drive teeth 46 that are adapted to engage the carrier teeth 50.

According to other aspects of this disclosure as it relates to the dispenser 10, the carrier 32 supports the product and may slide relative to the inner shell 34 when the actuator 30 is operated.

The drive arms 38A and 38B of the actuator 30 may be joined together at a base 40 at one end and are spaced from each other as they extend from the base 40 to a distal end, or tips 42 of the arms 38A and 38B. The two drive arms 38A and 38B may be spaced apart and may have outwardly oriented drive teeth 46.

The carrier 32 may define an opening 36 that receives the drive arms 38A and 38B of the actuator 30. The opening 36 may include carrier teeth 50 configured to engage the drive teeth 46 on the drive arms 38A and 38B of the actuator 30. The two drive arms 38A and 38B may be spaced apart and may have outwardly oriented surfaces that include the drive teeth 46. The opening 36 may include the carrier teeth 50 that are configured to engage the drive teeth 46 on the drive arms 38A and 38B of the actuator 30.

The drive arms 38A and 38B may have an expanded position and a compressed position, and the actuator 30 may be engaged to compress the drive arms 38A and 38B together to the compressed position to disengage the drive teeth 46 from the carrier teeth 50 to advance the product 12. The drive arms 38A and 38B may be moved to the expanded position after the product 12 is advanced to hold the carrier 32 stationary until the actuator 30 is subsequently operated.

The dispenser 10 may further comprise at least one spring 24 (two springs 24 are illustrated) disposed between the slider 22 and the inner shell 34 that biases the slider 22 away from the inner shell 34. The spring 24 facilitates returning the slider 22 to a return position after the slider 22 and the actuator 30 advance the carrier 32 and the product 12.

The dispenser 10 may further comprise a cap 18 having an end surface 59 configured to support the dispenser at an angle of between 5 and 20 degrees. The cap 18 defines a cavity 60 that contains the product 12. The product 12 is fully received in the cavity 60 and the carrier 32 is partially received in the cavity 60. The outer shell 20 may include a front wall 20A, and a back wall 20B that extend in one direction and are parallel to each other. The end surface 59 of the cap 18 is oriented at an angle relative to the one direction. When the dispenser 10 is supported on the end surface 59 of the cap 18, the front wall 20A and the back wall 20B of the dispenser 10 are disposed at the same angle relative to the one direction.

The dispenser 10 may further comprise a first latch part 52 provided on the inner shell 32, and a second latch part 56 provided on the slider 22. The first latch part 52 and the second latch part 56 are engaged when the carrier 32 is connected to the slider 22. The latch parts 52 and 56 and are disengaged to facilitate removal of the carrier 32 from the dispenser 10.

The dispenser 10 may further comprise a cap 18 defining a cup like enclosure 62 that is received on the inner shell 34 to enclose the product 12. The carrier 32 may be replaced with a cartridge 14 including a replacement carrier 32 and a replacement product 12. The outer shell 20, inner shell 34, actuator 30, and cap 18 need not be replaced when the replacement cartridge carrier 32 and product 12 are replaced.

According to another aspect of this disclosure, a dispenser system 10 is disclosed for a solid or semi-solid product 12 to be dispensed. The dispenser system 10 comprises an outer shell 20 and a slider 22 received within the outer shell 20. An inner shell 34 has a base wall 64 that defines an opening 66 and is assembled within the outer shell 20. A carrier 32 is disposed within the inner shell 34 with a product 12 to be dispensed being retained on the carrier 32. An actuator 30 extends from slider 22 and through the base wall 64 of the inner shell 34 and into an opening 68 defined by the carrier 32. The actuator 30 has a compressed position and an expanded position. The slider 22 is engaged to move the actuator 30 between the compressed position and the expanded position to advance the carrier 32 and the product 12 from the inner shell 34.

According to other aspects of this disclosure as it relates to a dispenser system 10, the actuator 30 may have outwardly oriented surfaces that include drive teeth 46, and the carrier 32 may define the opening 68 that receives the actuator 30. The opening 68 may include carrier teeth 50 configured to engage the drive teeth 46 on the actuator 30.

The dispenser system 10 may include drive arms 38A and 38B of the actuator 30 that are joined together by a base 40 at one end and are spaced from each other as they extend from the one end at the base 40 to a distal end, or tips 42 of the arms 38A and 38B.

The dispenser system 10 may further comprise at least one spring 24 disposed between the slider 22 and the inner shell 34 that biases the slider 22 away from the inner shell 34, wherein the at least one spring 24 facilitates returning the slider 22 to a return position after the slider 22 and the actuator 30 advance the carrier 34 and the product 12.

The dispenser system 10 may further comprise a cap 18 having an end surface 59 configured to support the dispenser 10. The cap 18 may define a cavity 60 in which the product 12 is fully received, and the carrier 32 is partially received in the cavity 60.

The outer shell 20 includes a front wall 20A, and a back wall 20B that extend in one direction and are parallel to each other. The end surface 59 is oriented at an angle relative to the one direction. When the dispenser 10 is supported on the end surface 59 of the cap 18, the front wall 20A and the back wall 20B of the dispenser 10 are disposed at the same angle between 5 and 20 degrees relative to the one direction.

The carrier 32 may be replaced with a cartridge 14 including a replacement carrier 32 and a replacement product 12.

It should be noted that the above systems and methods could be made with the inner shell 34 being integrated into the dispenser housing 16 for a wholly disposable packaging system 10 that would allow incremental advancement of the product 12 that may be quickly retracted for storage, The system and methods described provide greater flexibility in packaging bulk items, improved marketing of such items, reduced material consumption of packaging, and enhanced aesthetics and brand identity for the manufacturer.

Examples of several embodiments of the invention are described above, these embodiments do not describe all possible forms of the invention. The words used in the specification are words of description rather than limitation, and it is understood that various changes may be made within the scope of the invention. Features of various embodiments may be combined to form further embodiments of the invention.

We claim:

1. A dispenser for a product comprising:

an outer shell;

a slider disposed inside the outer shell;

an inner shell defining an opening, a carrier adapted to retain the product and is received in the inner shell, wherein the carrier includes carrier teeth; and an actuator connected between the slider and the carrier, the actuator is configured to advance the carrier and the product, the actuator including at least two drive arms that extend through the inner shell and into the carrier, the drive arms including drive teeth that are adapted to engage the carrier teeth.

2. The dispenser of claim 1 wherein the carrier supports the product and slides relative to the inner shell when the actuator is operated.

3. The dispenser of claim 1 wherein the drive arms of the actuator are joined together at one end and are spaced from each other as they extend from the one end to a distal end of the arms.

4. The dispenser of claim 1 wherein the two drive arms are spaced apart and have outwardly oriented surfaces that include drive teeth.

5. The dispenser of claim 1 wherein the carrier defines an opening that receives the drive arms of the actuator, wherein the opening includes carrier teeth configured to engage the drive arms of the actuator.

6. The dispenser of claim 1 wherein the two drive arms are spaced apart and have an outwardly oriented surfaces that include drive teeth, and wherein the carrier defines an opening that receives the drive arms of the actuator, wherein the opening includes carrier teeth configured to engage the drive teeth on the drive arms of the actuator.

7. The dispenser of claim 6 wherein the drive arms have an expanded position and a compressed position, wherein the actuator is engaged to compress the drive arms together to the compressed position to disengage the drive teeth from the carrier teeth to advance the product, and wherein the drive arms move to the expanded position after the product is advanced to hold the carrier stationary until the actuator is subsequently operated.

8. The dispenser of claim 1 further comprising:

at least one spring disposed between the slider and the inner shell biases the slider away from the inner shell, wherein the at least one spring facilitates returning the slider to a return position after the slider and the actuator advance the carrier and the product.

9. The dispenser of claim 1 further comprising:

a cap having an end surface configured to support the dispenser, the cap defining a cavity, wherein the product is fully received in the cavity and the carrier is partially received in the cavity.

10. The dispenser of claim 9 wherein the outer shell includes a front wall, and a back wall that extend in one direction and are parallel to each other, wherein the end surface is oriented at an angle relative to the one direction, and wherein when the dispenser is supported on the end surface of the cap, the front wall and the back wall of the dispenser are disposed at the same angle relative to the one direction.

11. The dispenser of claim 9 further comprising:

a first latch part provided on the inner shell; and a second latch part provided on the outer shell, wherein the first latch part and the second latch part are engaged when the inner shell is connected to the outer shell, and wherein the first latch part and second latch part are disengaged to facilitate removal of the inner shell and carrier from the dispenser.

12. The dispenser of claim 1 further comprising a cap defining a cup like enclosure that is received on the inner shell to enclose the product, wherein the carrier is replaced with a cartridge including a replacement carrier and a replacement product.

13. The dispenser of claim 12 wherein the outer shell, inner shell, actuator, and cap are not replaced when the replacement carrier and product are replaced.

14. A dispenser system comprising:

an outer shell;

a slider received within the outer shell;

an inner shell assembled within the outer shell, the inner shell having a base wall defining an opening;

a carrier disposed within the inner shell, the carrier defining a carrier opening;

a product retained on the carrier; and an actuator extending from slider and through the opening in the base wall of the inner shell and into a carrier opening defined by the carrier, wherein the actuator has a compressed position and an expanded position, and wherein the slider is engaged to move the actuator between the compressed position and the expanded position to advance the carrier and the product from the inner shell.

15. The dispenser system of claim 14 wherein the actuator has outwardly oriented surfaces that include drive teeth, and wherein the carrier defines an opening that receives the actuator, wherein the opening includes carrier teeth configured to engage the drive teeth on the actuator.

16. The dispenser system of claim 14 wherein the actuator moves to the expanded position after the product is advanced to hold the carrier stationary until the actuator is subsequently operated.

17. The dispenser system of claim 14 further comprising:

at least one spring disposed between the slider and the inner shell biases the slider away from the inner shell, wherein the at least one spring facilitates returning the slider to a return position after the slider and the actuator advance the carrier and the product.

18. The dispenser system of claim 14 further comprising:

a cap having an end surface configured to support the dispenser, the cap defining a cavity, wherein the product is fully received in the cavity and the carrier is partially received in the cavity.

19. The dispenser system of claim 18 wherein the outer shell includes a front wall, and a back wall that extend in one direction and are parallel to each other, wherein the end surface is oriented at an angle relative to the one direction, and wherein when the dispenser is supported on the end surface of the cap, the front wall and the back wall of the dispenser are disposed at the same angle relative to the one direction.

20. The dispenser system of claim 14 further comprising a cap defining a cup like enclosure that is received on the inner shell to enclose the product, wherein the carrier is replaced with a cartridge including a replacement carrier and a replacement product.

* * * * *